US007982168B2

(12) United States Patent
Middleton et al.

(10) Patent No.: US 7,982,168 B2
(45) Date of Patent: Jul. 19, 2011

(54) ABSORBENT MICROWAVE INTERACTIVE PACKAGING

(75) Inventors: Scott W. Middleton, Oshkosh, WI (US); Terrence P. Lafferty, Winneconne, WI (US); William J. Schulz, Wausau, WI (US)

(73) Assignee: Graphic Packaging International, Inc., Marietta, GA (US)

( * ) Notice: Subject to any disclaimer, the term of this patent is extended or adjusted under 35 U.S.C. 154(b) by 1196 days.

(21) Appl. No.: 11/673,136

(22) Filed: Feb. 9, 2007

(65) Prior Publication Data

US 2007/0145045 A1 Jun. 28, 2007

Related U.S. Application Data

(63) Continuation-in-part of application No. 11/211,858, filed on Aug. 25, 2005, now abandoned.

(60) Provisional application No. 60/604,637, filed on Aug. 25, 2004.

(51) Int. Cl.
*H05B 6/80* (2006.01)

(52) U.S. Cl. ..... 219/730; 219/759; 428/35.7; 428/35.2

(58) Field of Classification Search ..... 219/730, 219/732, 734, 756, 759; 426/107, 124, 234; 428/35.7, 286, 287, 35.2; 233/242
See application file for complete search history.

(56) References Cited

U.S. PATENT DOCUMENTS

| | | | | |
|---|---|---|---|---|
| 4,775,771 | A | | 10/1988 | Pawlowski |
| 4,865,921 | A | | 9/1989 | Hollenberg |
| 4,890,439 | A | | 1/1990 | Smart |
| 4,935,276 | A | * | 6/1990 | Pawlowski et al. ..... 428/35.7 |
| 4,936,935 | A | | 6/1990 | Beckett |
| 4,948,932 | A | | 8/1990 | Clough |
| 4,954,356 | A | | 9/1990 | Kappes |
| 4,963,424 | A | | 10/1990 | Beckett |
| 5,039,364 | A | | 8/1991 | Becket et al. |
| 5,041,325 | A | | 8/1991 | Larson |
| 5,093,176 | A | | 3/1992 | Pribonic et al. |
| 5,117,078 | A | | 5/1992 | Beckett |
| 5,124,519 | A | | 6/1992 | Roy |
| 5,213,902 | A | | 5/1993 | Beckett |
| 5,221,419 | A | | 6/1993 | Beckett |
| 5,260,537 | A | | 11/1993 | Beckett |
| 5,266,386 | A | | 11/1993 | Beckett |
| RE34,683 | E | | 8/1994 | Maynard |
| 5,340,436 | A | | 8/1994 | Beckett |
| 5,354,973 | A | | 10/1994 | Beckett |
| 5,410,135 | A | | 4/1995 | Pollart |
| 5,424,517 | A | | 6/1995 | Habeger |
| 5,519,195 | A | | 5/1996 | Keefer |
| 5,628,921 | A | | 5/1997 | Beckett |
| 5,672,407 | A | | 9/1997 | Beckett |
| 5,759,422 | A | | 6/1998 | Schmelzer |
| 5,800,724 | A | | 9/1998 | Habeger |
| 6,114,679 | A | | 9/2000 | Lai |

(Continued)

FOREIGN PATENT DOCUMENTS

| | | |
|---|---|---|
| JP | 1963-185005 | 11/1988 |

(Continued)

*Primary Examiner* — Quang T Van

(74) *Attorney, Agent, or Firm* — Womble Carlyle Sandridge & Rice, PLLC

(57) ABSTRACT

Various constructs that absorb exudates and enhance browning and crisping of a food item during heating in a microwave oven are provided.

42 Claims, 8 Drawing Sheets

U.S. PATENT DOCUMENTS

| | | | | |
|---|---|---|---|---|
| 6,150,646 | A | 11/2000 | Lai | |
| 6,204,492 | B1 | 3/2001 | Zeng | |
| 6,251,451 | B1 | 6/2001 | Zeng | |
| 6,414,290 | B1 | 7/2002 | Cole | |
| 6,433,322 | B2 | 8/2002 | Zeng | |
| 6,455,827 | B2 | 9/2002 | Zeng | |
| 6,552,315 | B2 | 4/2003 | Zeng | |
| 6,677,563 | B2 | 1/2004 | Lai | |
| 6,717,121 | B2 | 4/2004 | Zeng | |
| 6,765,182 | B2 | 7/2004 | Cole | |
| 2003/0087051 | A1 * | 5/2003 | Murray | 428/35.2 |
| 2003/0144121 | A1 | 7/2003 | Walsh | |
| 2004/0023000 | A1 | 2/2004 | Young et al. | |
| 2006/0049190 | A1 | 3/2006 | Middleton | |
| 2010/0120313 | A1 | 5/2010 | Bohme et al. | |

FOREIGN PATENT DOCUMENTS

| | | |
|---|---|---|
| JP | 2004-109141 | 9/1992 |
| JP | 2001-248075 | 9/2001 |
| JP | 2002-186470 | 7/2002 |
| WO | WO 03/066435 A2 | 8/2003 |

* cited by examiner

ABSORBENT MICROWAVE INTERACTIVE PACKAGING

CROSS-REFERENCE TO RELATED APPLICATION

This application is a continuation-in-part of U.S. patent application Ser. No. 11/211,858, filed Aug. 25, 2005, which claims the benefit of U.S. Provisional Application No. 60/604,637, filed Aug. 25, 2004, both of which are incorporated by reference in their entirety.

TECHNICAL FIELD

The present invention relates to absorbent constructs having microwave interactive properties.

BACKGROUND

Microwave ovens commonly are used to cook food in a rapid and effective manner. Many materials and packages have been designed for use in a microwave oven. During the heating process, many food items release water, juices, oils, fats, grease, and blood (collectively referred to herein as "exudate"). Typically, the exudate pools beneath the food item. While some pooling may enhance browning and crisping of the food item, excessive pooling of exudate may impede browning and crisping. Thus, there is a need for a structure that absorbs the food item exudates during storage and cooking. There is further a need for a structure that absorbs exudates and enhances browning and crisping of the food item in a microwave oven.

SUMMARY

The present invention generally relates to various materials, structures, blanks, sleeves, packages, trays, and other constructs that absorb exudates and enhance browning and crisping of a food item during heating in a microwave oven.

BRIEF DESCRIPTION OF THE DRAWINGS

The description refers to the accompanying drawings, some of which are schematic, and in which like reference characters refer to like parts throughout the several views.

DETAILED DESCRIPTION

The present invention relates generally to various absorbent materials and structures, and various blanks, sleeves, packages, trays, and other constructs (collectively "constructs") formed therefrom for use in packaging and heating microwavable food items. The various constructs may be used with numerous food items, for example, meat, poultry, bacon, convenience foods, pizza, sandwiches, desserts, and popcorn and other snack foods.

The present invention may be best understood by referring to the figures. For purposes of simplicity, like numerals may be used to describe like features. However, it should be understood use of like numerals is not to be construed as an acknowledgement or admission that such features are equivalent in any manner. It also will be understood that where a plurality of similar features are depicted, not all of such identical features may be labeled on the figures.

Figure 1:
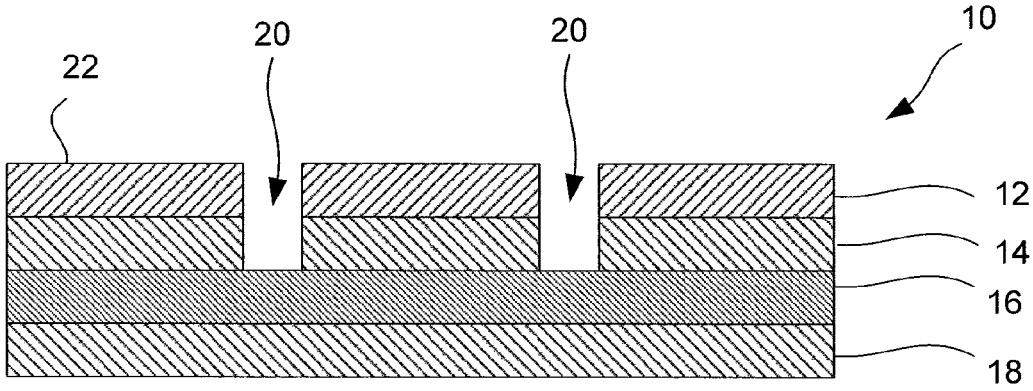
FIG. 1 depicts an exemplary absorbent structure according to various aspects of the present invention.

FIG. 1 illustrates a schematic cross-sectional view of an exemplary structure 10 for forming a heating, browning, and/or crisping sheet, sleeve, or other package according to various aspects of the present invention. The structure 10 includes a plurality of superposed and/or adjoined layers. It will be understood that while particular combinations of layers are described herein, other combinations of layers are contemplated hereby.

Viewing FIG. 1, the structure 10 includes a susceptor film comprising a food-contacting layer 12 and a layer of microwave energy interactive material 14. The susceptor typically is used to enhancing browning and crisping of the food item. The susceptor film may be in proximate contact with the surface of the food item, intimate contact with the food item, or a combination thereof, as needed to achieve the desired cooking results. Thus, a sheet, sleeve, package, or other construct with one or more integrated susceptors may be used to cook a food item and to brown or crisp the surface of the food item in a way similar to conventional frying, baking, or grilling. Numerous particular susceptor configurations, shapes, and sizes are known in the art.

The microwave energy interactive layer may comprise an electroconductive or semiconductive material, for example, a metal or a metal alloy provided as a metal foil; a vacuum deposited metal or metal alloy; or a metallic ink, an organic ink, an inorganic ink, a metallic paste, an organic paste, an inorganic paste, or any combination thereof. Examples of metals and metal alloys that may be suitable for use with the present invention include, but are not limited to, aluminum, chromium, copper, inconel alloys (nickel-chromium-molybdenum alloy with niobium), iron, magnesium, nickel, stainless steel, tin, titanium, tungsten, and any combination thereof.

While metals are inexpensive and easy to obtain in both vacuum deposited or foil forms, metals may not be suitable for every application. For example, in high vacuum deposited thickness and in foil form, metals are opaque to visible light and may not be suitable for forming a clear microwave package or component. Further, the interactive properties of such vacuum deposited metals for heating often are limited to heating for narrow ranges of heat flux and temperature. Such materials therefore may not be optimal for heating, browning, and crisping all food items. Additionally, for field management uses, metal foils and vacuum deposited coatings can be difficult to handle and design into packages, and can lead to arcing at small defects in the structure.

Thus, according to another aspect of the present invention, the microwave interactive energy material may comprise a metal oxide. Examples of metal oxides that may be suitable for use with the present invention include, but are not limited to, oxides of aluminum, iron, and tin, used in conjunction with an electrically conductive material where needed. Another example of a metal oxide that may be suitable for use with the present invention is indium tin oxide (ITO). ITO can be used as a microwave energy interactive material to provide a heating effect, a shielding effect, or a combination thereof. To form the susceptor, ITO typically is sputtered onto a clear polymeric film. As used herein, "film" refers to a thin, continuous sheet of a substance or combination of substances, including, but not limited to, thermoplastic materials. The sputtering process typically occurs at a lower temperature than the evaporative deposition process used for metal deposition. ITO has a more uniform crystal structure and, therefore, is clear at most coating thicknesses. Additionally, ITO can be used for either heating or field management effects. ITO also may have fewer defects than metals, thereby making thick coatings of ITO more suitable for field management than thick coatings of metals, such as aluminum.

Alternatively, the microwave energy interactive material may comprise a suitable electroconductive, semiconductive, or non-conductive artificial dielectric or ferroelectric. Artificial dielectrics comprise conductive, subdivided material in a polymeric or other suitable matrix or binder, and may include flakes of an electroconductive metal, for example, aluminum.

As illustrated in FIG. 1, the food-contacting layer 12 overlies and, in some cases, supports, the microwave energy interactive material 14 and typically comprises an electrical insulator, for example, a polymeric film. The thickness of the film may typically be from about 40 to about 55 gauge. In one aspect, the thickness of the film is from about 43 to about 52 gauge. In another aspect, the thickness of the film is from about 45 to about 50 gauge. In still another aspect, the thickness of the film is about 48 gauge. Examples of polymeric films that may be suitable include, but are not limited to, polyolefins, polyesters, polyamides, polyimides, polysulfones, polyether ketones, cellophanes, or any combination thereof. Other non-conducting substrate materials such as paper and paper laminates, metal oxides, silicates, cellulosics, or any combination thereof also may be used.

According to one aspect of the present invention, the polymeric film may comprise polyethylene terephthalate (PET). Examples of polyethylene terephthalate film that may be suitable for use as the substrate include, but are not limited to, MELINEX®, commercially available from DuPont Teijan Films (Hopewell, Va.), and SKYROL, commercially available from SKC, Inc. (Covington, Ga.). Polyethylene terephthalate films are used in commercially available susceptors, for example, the QWIK WAVE® Focus susceptor and the MICRO-RITE® susceptor, both available from Graphic Packaging International (Marietta, Ga.).

The microwave energy interactive material may be applied to the food-contacting layer or substrate in any suitable manner, and in some instances, the microwave energy interactive material is printed on, extruded onto, sputtered onto, evaporated on, or laminated to the substrate. The microwave energy interactive material may be applied to the substrate in any pattern, and using any technique, to achieve the desired heating effect of the food item. For example, the microwave energy interactive material may be provided as a continuous or discontinuous layer or coating, circles, loops, hexagons, islands, squares, rectangles, octagons, and so forth. Examples of alternative patterns and methods that may be suitable for use with the present invention are provided in U.S. Pat. Nos. 6,765,182; 6,717,121; 6,677,563; 6,552,315; 6,455,827; 6,433,322; 6,414,290; 6,251,451; 6,204,492; 6,150,646; 6,114,679; 5,800,724; 5,759,422; 5,672,407; 5,628,921; 5,519,195; 5,424,517; 5,410,135; 5,354,973; 5,340,436; 5,266,386; 5,260,537; 5,221,419; 5,213,902; 5,117,078; 5,039,364; 4,963,424; 4,936,935; 4,890,439; 4,865,921; 4,775,771; and Re. 34,683; each of which is incorporated by reference herein in its entirety. Although particular examples of the microwave energy interactive material are shown and described herein, it will be understood that other patterns of microwave energy interactive material are contemplated by the present invention.

Still viewing FIG. 1, the microwave energy interactive layer 14 overlies an absorbent layer 16. The absorbent layer 16 may be formed from any material capable of absorbing exudates from a food item during microwave heating. For example, in this and other aspects of the present invention, the absorbent layer may be formed from a cellulosic material, a polymeric material or polymer, or any combination thereof, and may be a woven or nonwoven material.

Examples of cellulosic materials that may be suitable for use with the present invention include, but are not limited to, wood fluff, wood fluff pledgets, tissue, and toweling. The cellulosic material may comprise pulp fibers, or fibers from other sources, for example, flax, milkweed, abaca, hemp, cotton, or any combination thereof. Processes used to form cellulosic materials are well known to those in the art and are not described herein.

Typically, fibers are held together in paper and tissue products by hydrogen bonds and covalent and/or ionic bonds. In some instances, it may be beneficial to bond the fibers in a manner that immobilizes the fiber-to-fiber bond points and renders them resistant to disruption in the wet state, for example, when exposed to water or other aqueous solutions, blood, fats, grease, and oils. Thus, the cellulosic material optionally includes a wet strength resin. However, such wet strength resins typically decrease absorbency and, therefore, the desired properties must be balanced.

In one aspect, the absorbent material is capable of absorbing at least about 0.5 g of exudate from a food item per gram of absorbent material. In another aspect, the absorbent material is capable of absorbing at least about 1 g of exudate from a food item per gram of absorbent material. In yet another aspect, the absorbent material is capable of absorbing at least about 1.25 g of exudate from a food item per gram of absorbent material. In another aspect, the absorbent material is capable of absorbing at least about 1.5 g of exudate from a food item per gram of absorbent material. In yet another aspect, the absorbent material is capable of absorbing at least about 1.75 g of exudate from a food item per gram of absorbent material. In still another aspect, the absorbent material is capable of absorbing at least about 2 g of exudate from a food item per gram of absorbent material. In another aspect, the absorbent material is capable of absorbing at least about 2.5 g of exudate from a food item per gram of absorbent material. In another aspect, the absorbent material is capable of absorbing at least about 4 g of exudate from a food item per gram of absorbent material. In yet another aspect, the absorbent material is capable of absorbing at least about 5 g of exudate from a food item per gram of absorbent material. In another aspect, the absorbent material is capable of absorbing at least about 8 g of exudate from a food item per gram of absorbent material. In yet another aspect, the absorbent material is capable of absorbing at least about 10 g of exudate from a food item per gram of absorbent material. In still another aspect, the absorbent material is capable of absorbing at least about 12 g of exudate from a food item per gram of absorbent material. In another aspect, the absorbent material is capable of absorbing at least about 15 g of exudate from a food item per gram of absorbent material.

In one particular example, the absorbent layer comprises Fiber Mark™ blotter board product commercially available under the name Reliance™. The Fiber Mark™ blotter board may absorb from about 7 to about 9 g of oil per cubic inch from a single serving of snack food. Further, the blotter board may be about 0.025 inch thick with a basis weight of about 370 grams per square meter (227.4 pounds per 3,000 square feet).

In another aspect, the absorbent layer comprises a polymeric material. As used herein the term "polymeric material" or "polymer" includes, but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic, and random symmetries.

Typical thermoplastic polymers that may be used with the present invention include, but are not limited to, polyolefins, e.g. polyethylene, polypropylene, polybutylene, and copolymers thereof, polytetrafluoroethylene, polyesters, e.g. polyethylene terephthalate, polyvinyl acetate, polyvinyl chloride acetate, polyvinyl butyral, acrylic resins, e.g. polyacrylate, and polymethylacrylate, polymethylmethacrylate, polyamides, namely nylon, polyvinyl chloride, polyvinylidene chloride, polystyrene, polyvinyl alcohol, polyurethanes, cellulosic resins, namely cellulosic nitrate, cellulosic acetate, cellulosic acetate butyrate, ethyl cellulose, etc., copolymers of any of the above materials, e.g., ethylene-vinyl acetate copolymers, ethylene-acrylic acid copolymers, and styrene-butadiene block copolymers, Kraton brand polymers.

In yet another aspect, the absorbent layer may comprise both a cellulosic material and a polymeric material. Examples of such materials that may be suitable include, but are not limited to, coform materials, felts, needlepunched materials, or any combination thereof.

According to one aspect of the present invention, the absorbent layer comprises a coform material formed from a coform process. As used herein, the term "coform process" refers to a process in which at least one meltblown diehead is arranged near a chute through which other materials are added to polymeric meltblown fibers to form a web. The web then may be calendared, bonded, and/or wound into a roll. Such other materials may be pulp, cellulose, or staple fibers, for example.

As used herein the term "meltblown fibers" refers to fine fibers of unoriented polymer formed from a meltblowing process. Meltblown fibers are often formed by extruding a molten thermoplastic material through a plurality of fine, usually circular, die capillaries as molten threads or filaments into converging high velocity, usually hot, gas (e.g. air) streams which attenuate the filaments of molten thermoplastic material to reduce their diameter, which may be to microfiber diameter. Thereafter, the meltblown fibers are carried by the high velocity gas stream and deposited on a collecting surface to form a web of randomly disbursed meltblown fibers. Meltblown fibers may be continuous or discontinuous, and are generally smaller than 10 microns in average diameter.

As used herein, the term "nonwoven" material or fabric or web refers to a web having a structure of individual fibers or threads which are interlaid, but not in an identifiable manner as in a knitted fabric. Nonwoven fabrics or webs have been formed from many processes such as for example, spunbonding processes, meltblowing processes, and bonded carded web processes.

As used herein the term "spunbond fibers" refers to small diameter fibers of molecularly oriented polymer formed from a spunbonding process. Spunbond fibers are formed by extruding molten thermoplastic material as filaments from a plurality of fine, usually circular capillaries of a spinneret with the diameter of the extruded filaments then being rapidly reduced.

"Bonded carded web" refers to webs made from staple fibers that are sent through a combing or carding unit, which breaks apart and aligns the staple fibers in the machine direction to form a generally machine direction-oriented fibrous nonwoven web. Such fibers usually are purchased in bales that are placed in a picker that separates the fibers prior to the carding unit. Once the web is formed, it then is bonded by one or more of several known bonding methods. One such bonding method is powder bonding, wherein a powdered adhesive is distributed through the web and then activated, usually by heating the web and adhesive with hot air. Another suitable bonding method is pattern bonding, wherein heated calender rolls or ultrasonic bonding equipment are used to bond the fibers together, usually in a localized bond pattern, though the web can be bonded across its entire surface if so desired. Another suitable and well-known bonding method, particularly when using bicomponent staple fibers, is through-air bonding.

In one aspect, the absorbent layer comprises a felt. As used herein, a "felt" refers to a matted nonwoven material formed from natural and/or synthetic fibers, made by a combination of mechanical and chemical action, pressure, moisture, and heat. Any of the fibers and polymers described herein may be used to form a felt in accordance with the present invention. Thus, for example, a felt may be formed from polyethylene terephthalate or polypropylene. A felt used in accordance with the present invention may have a basis weight of from about 50 lbs/ream (3000 square feet) to about 100 lbs/ream, for example, 75 lbs/ream. In one aspect, the felt has a basis weight of from about 50 to about 60 lbs/ream. In another aspect, the felt has a basis weight of from about 60 to about 70 lbs/ream. In yet another aspect, the felt has a basis weight of from about 70 to about 80 lbs/ream. In still another aspect, the felt has a basis weight of from about 80 to about 90 lbs/ream. In a still further aspect, the felt has a basis weight of from about 90 to about 100 lbs/ream. Examples of felt materials that may be suitable for use with the present invention are those commercially available from HDK Industries (Greenville, S.C.), Hollingsworth & Vose Company (East Walpole, Mass.), and BBA Fiberweb (Charlotte, N.C.).

In another aspect, the absorbent layer comprises a needlepunched material formed from a needlepunching process. As used herein, "needlepunching" refers to a process of converting batts of loose fibers into a coherent nonwoven fabric in which barbed needles are punched through the batt, thereby entangling the fibers. Any of the fibers and polymers described herein may be used to form a needlepunched material in accordance with the present invention. For example, the absorbent layer may comprise a needlepunched spunbond material with cotton fibers and/or pulp fibers.

In any of the structures described herein or contemplated hereby, a superabsorbent material may be used to enhance absorbency of the structure. As used herein a "superabsorbent" or "superabsorbent material" refers to a water-swellable, water-soluble organic or inorganic material capable, under favorable conditions, of absorbing at least about 20 times its weight and, more desirably, at least about 30 times its weight in an aqueous solution containing 0.9 weight percent sodium chloride. Organic materials suitable for use as a superabsorbent material in conjunction with the present invention include, but are not limited to, natural materials such as guar gum, agar, pectin and the like; as well as synthetic materials, such as synthetic hydrogel polymers. Such hydrogel polymers include, for example, alkali metal salts of polyacrylic acids, polyacrylamides, polyvinyl alcohol, ethylene, maleic anhydride copolymers, polyvinyl ethers, methyl cellulose, carboxymethyl cellulose, hydroxypropylcellulose, polyvinylmorpholinone, and polymers and copolymers of vinyl sulfonic acid, polyacrylates, polyacrylamides, polyvinylpyrridine, and the like. Other suitable polymers include hydrolyzed acrylonitrile grafted starch, acrylic acid grafted starch, and isobutylene maleic anhydride polymers and mixtures thereof. The hydrogel polymers are preferably lightly crosslinked to render the materials substantially water insoluble. Crosslinking may, for example, be accomplished by irradiation or by covalent, ionic, van der Waals, or hydrogen bonding. The superabsorbent materials may be in any form suitable for use in the absorbent structure including particles, fibers, flakes, spheres and the like. Typically the superabsorbent material is present within the absorbent structure in an amount from about 5 to about 95 weight percent based on total weight of the absorbent structure. Superabsorbents are generally available in particle sizes ranging from about 20 to about 1000 microns.

Still viewing FIG. 1, the structure 10 also includes a liquid impervious layer 18 to contain the exudates released from the food item. When the structure 10 is used to form a package, the liquid impervious 18 maintains a dry feel when grasped by a user. Additionally, the liquid impervious 18 prevents the exudates from leaking from a package that incorporates the absorbent structure 10.

Any hydrophobic and/or oleophobic material may be used to form the liquid impervious layer. Examples of materials that may be suitable include, but are not limited to polyolefins, such as polypropylene, polyethylene, and copolymers thereof, acrylic polymers, fluorocarbons, polyamides, polyesters, polyolefins, acrylic acid copolymer, partially neutralized acid copolymers, and paraffin waxes. These materials may be used individually, as mixtures, or in coextruded layers.

The liquid impervious layer may be formed using any suitable method, technique or process known in the art including, but not limited to, lamination, extrusion, and solution coating. Thus, the liquid impervious layer may be a film that is laminated to the construct, or may be applied as a solution, molten polymer, or the like directly to the construct.

A plurality of partial slits, apertures, embossments, or perforations 20 (collectively "perforations") may be provided in the structure pathway from the food-contacting surface 22, through the various layers to the absorption layer 16. As seen in FIG. 1, the perforations 20 extend through the various layers 12 and 14 but do not extend through the absorption layer 16 or liquid impervious layer 18. In this way, exudate from the food may travel through the perforations and be absorbed by the absorbent layer.

If desired, the perforations may extend through the entire thickness of the construct. However, in such arrangements the exudates will be absorbed primarily in the absorbent layer, but some liquid may be left on the microwave tray or otherwise on the outside surface of the package.

Although shown in particular arrangements herein, the perforations may have or be arranged in numerous possible shapes such as circles, ellipses, trapezoids, or any other shape needed or desired. The number and arrangement of perforations may vary depending on the liquid content of a food item intended for placement on or in the construct, and any number of other factors.

Figure 2:
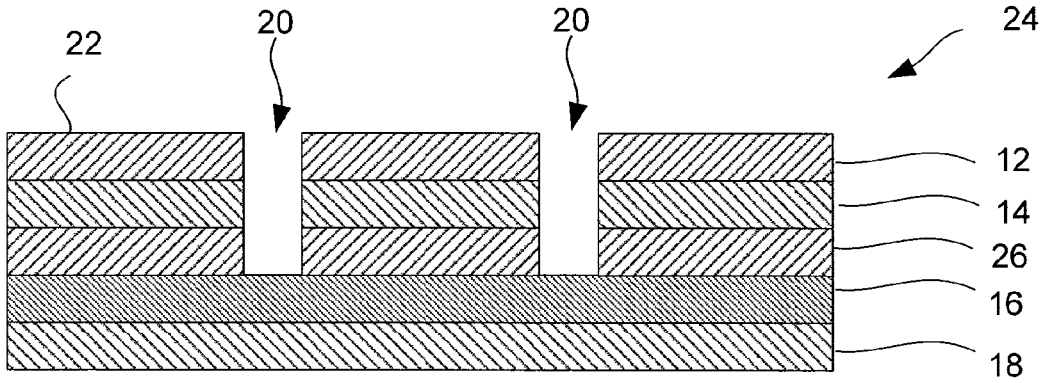
FIG. 2 depicts another exemplary absorbent structure according to various aspects of the present invention.

As shown in another exemplary construct 24 in FIG. 2, the susceptor film 12, 14 may be laminated to a support 26. The support may be formed from paper, paperboard, a low shrink polymer, or any other suitable material. Thus, for example, a metallized polymer film may be laminated to a paper, for example, a kraft paper, or alternatively, a low shrink polymer film, for example, a cast nylon 6 or nylon 6,6 film, or a coextruded film containing such polymers, and jointly apertured. One such material that may be suitable for use with the present invention is DARTEK, commercially available from DuPont Canada. Where the support is paper, the support may have a basis weight of about 15 to about 30 lbs/ream. In one aspect, the paper support as a basis weight of about 20 to about 30 lbs/ream. In another aspect, the paper support has a basis weight of about 25 lbs/ream. Where the support is paperboard, the support may have a thickness of about 8 to about 20 mils. In one aspect, the paperboard support has a thickness of about 10 to about 18 mils. In another aspect, the paperboard support has a thickness of about 13 mils.

As shown in FIG. 2, the perforations 20 that extend layers 12 and 14 also may extend through the support 26. Alternatively, the support 26 may be provided with slits or other features (not shown) that allow the exudate to pass through to the absorption layer 16.

Figure 3A:
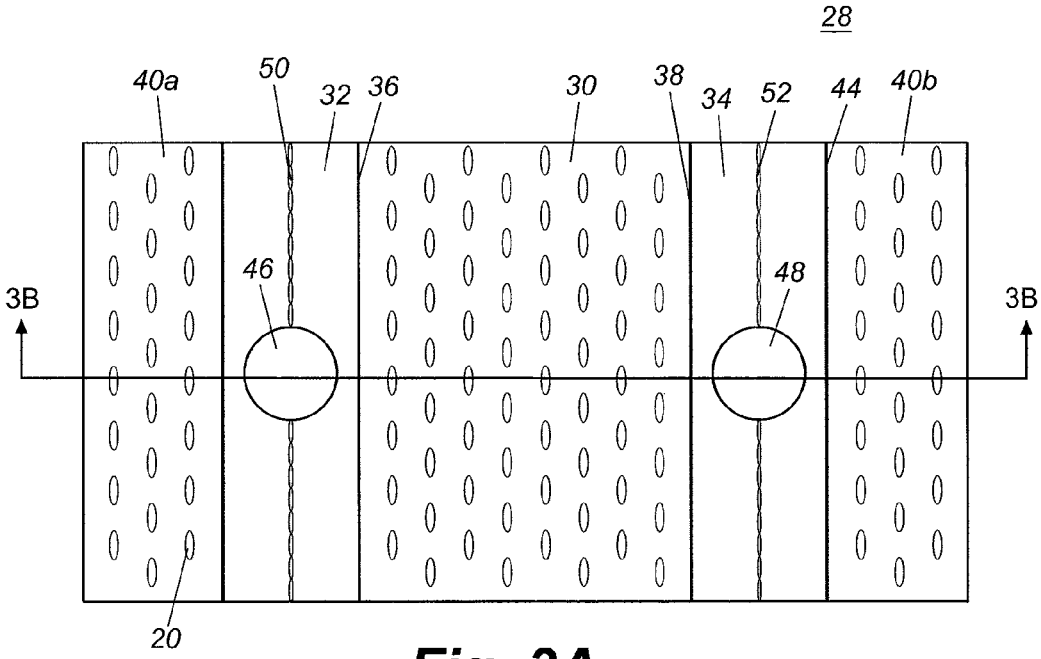
FIGS. 3A and 3B depict an exemplary blank according to various aspects of the present invention, formed from the absorbent structure of FIG. 2.
Figure 3B:
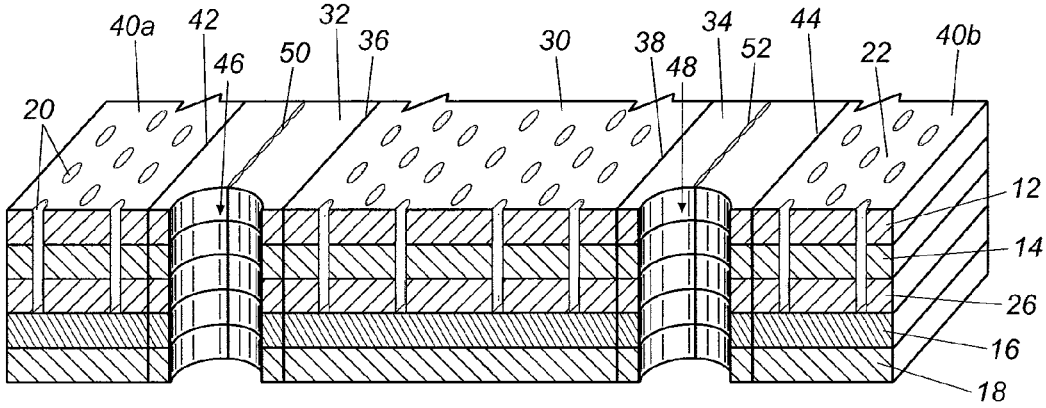

FIGS. 3A and 3B illustrate an exemplary blank 28 formed from the absorbent structure 24 of FIG. 2. The blank 28 includes a plurality of panels joined by fold lines. A bottom panel 30 is joined to a first side panel 32 and a second side panel 34 by fold lines 36 and 38, respectively. The first side panel 32 is joined to a first top panel portion 40*a* by fold line 42. The second side panel 34 is joined to a second top panel portion 40*b* by fold line 44. The first side panel 32 and the second side panel 34 include apertures 46 and 48, respectively, generally along the centerline of the panel. Such apertures typically are for venting a food item contained in a package formed from the blank 28. It will be understood that such venting apertures are optional, and that numerous other venting features and configurations are contemplated hereby. While not wishing to be bound by theory, such apertures also are believed to allow a portion of microwave energy to enter the food item directly, primarily to heat the center of the food item, as described in U.S. Pat. No. 4,948,932 titled "Apertured Microwave Reactive Package", issued on Aug. 14, 1990, which is incorporated by reference herein in its entirety. The first side panel 32 and the second side panel 34 also include respective fold lines 50 and 52 that form gussets in a package or sleeve formed from the blank 28.

Figure 4:
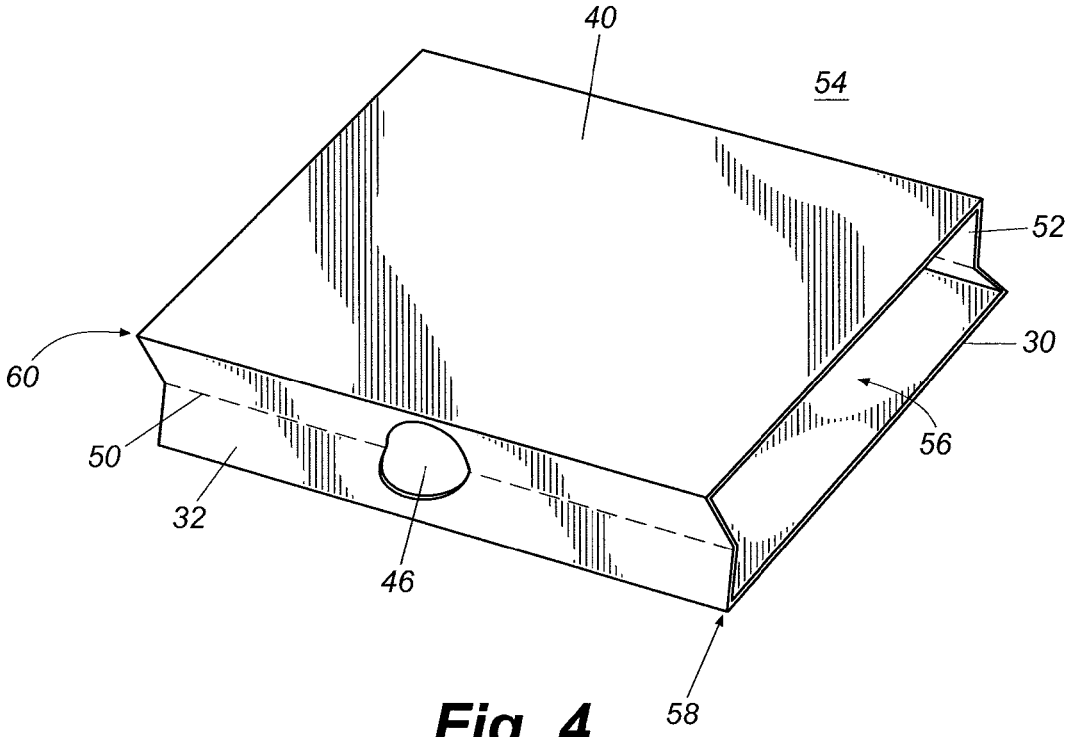
FIG. 4 depicts an exemplary sleeve according to various aspects of the present invention, formed from the blank of FIGS. 3A and 3B.

FIG. 4 depicts the blank 28 of FIG. 3A folded into a sleeve 54. To form the sleeve 56, the various panels are folded along fold lines 36, 38, 42, 44. The first top panel portion 40*a* and second top panel portion 40*b* are brought toward each other and overlapped so that the resulting top panel 40 (also referred to herein as "food-opposing panel") substantially has the same dimensions as bottom panel 30 (also referred to herein as "food-bearing panel"). However, it will be understood that in other package configurations, such symmetry may not be required or desirable. Numerous package shapes and configurations are contemplated hereby. The first top panel portion 40*a* and second top panel portion 40*b* are glued or otherwise joined to form sleeve 54 having a cavity 56 for receiving a food item (not shown) and open ends 58 and 60. The first side panel 32 and the second side panel 34 are folded toward the cavity 56 along fold lines 50 and 52.

When a food item is heated therein, any exudate from the food item flows through perforations 20 in the various layers, is absorbed by the absorbent layer 16, and is contained by the liquid impervious 18 (see FIG. 3B). Thus, when a user removes the food item from a microwave oven, little or no exudate leaks from the sleeve 54.

Figure 5A:
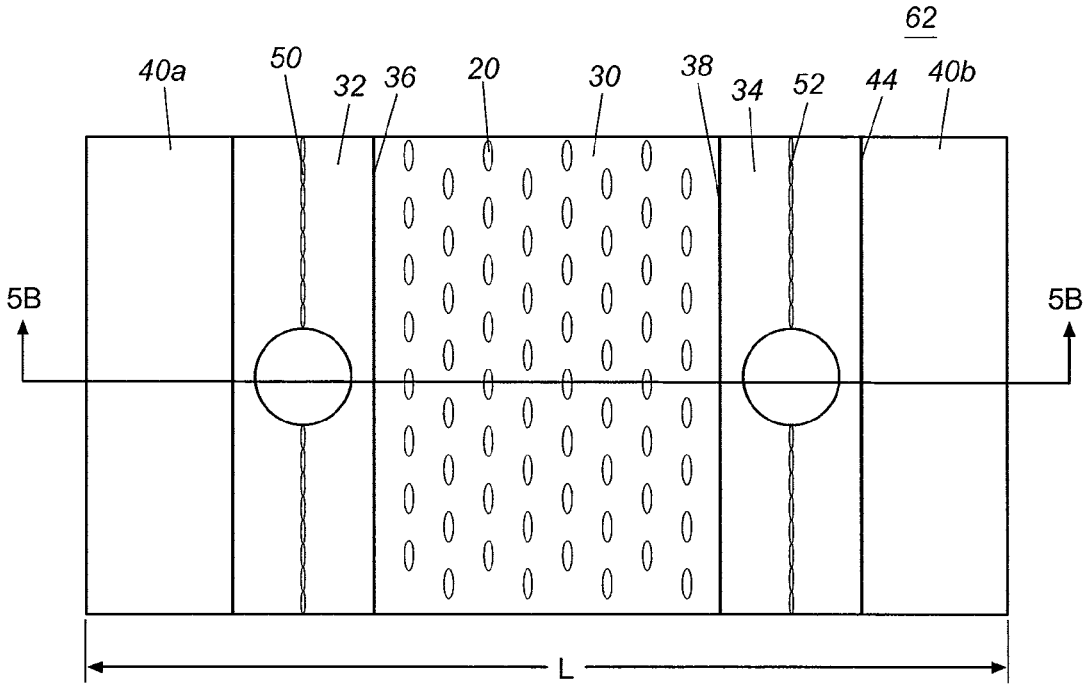
FIGS. 5A and 5B depict another exemplary blank according to various aspects of the present invention.
Figure 5B:
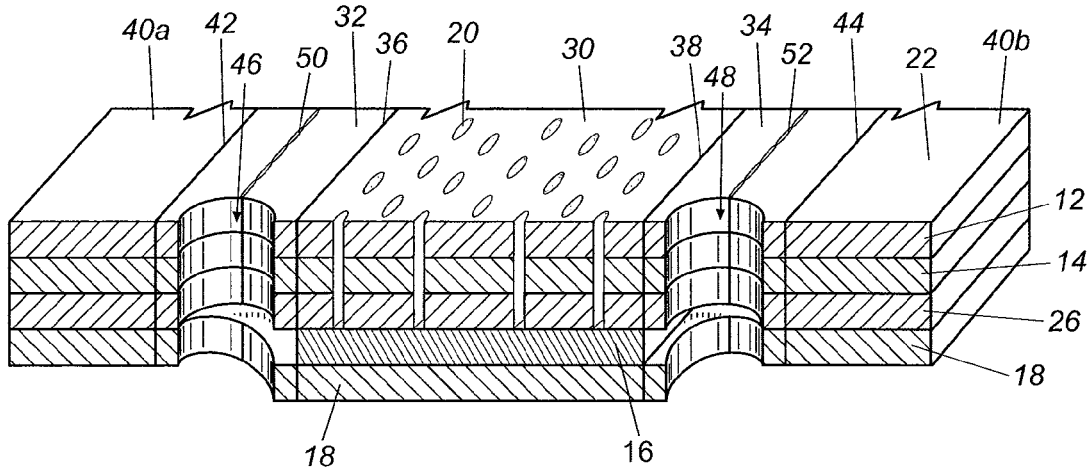

FIGS. 5A and 5B depict another exemplary blank 62 according to various aspects of the present invention. In this example, the absorbent layer 16 is only provided along a portion of the length L of the blank 62. In this example, the absorbent material 16 is positioned only along the bottom panel 30 of a sleeve formed from the blank 62. Additionally, perforations 20 are provided only in the bottom panel 30 to allow for the flow of exudates to the absorbent layer 16. By forming the blank 62 with only a partial absorbent layer 16, the blank 62 may be easier to fold, more flexible, less costly, and easier to insert food items therein as compared with a blank having a complete absorbent layer (such as that shown in FIGS. 3A and 3B).

It will be understood that while certain constructs are discussed herein, numerous other absorbent structures, materials, sleeves, packages, and constructs are contemplated hereby. Additionally, it will be understood that numerous other layers may be used in accordance with the present invention. For example, in one aspect, the construct may include an "insulating microwave material" or "microwave energy interactive insulating material". As used herein, an "insulating microwave material" refers to any arrangement of layers, such as polyester layers, susceptor layers, polymer layers, paper layers, continuous and discontinuous adhesive layers, and patterned adhesive layers that provide a thermal insulating effect. The package may include one or more susceptors, one or more expandable insulating cells, or a combination of susceptors and expandable insulating cells. Examples of materials that may be suitable, alone or in combination, include, but are not limited to, are Qwik Wave® Susceptor packaging material, Qwik Wave® Focus® packaging material, Micro-Rite® packaging material, MicroFlex® Q packaging material, and QuiltWave™ Susceptor packaging material, each of which is commercially available from Graphic Packaging International, Inc. Examples of such materials are described in PCT Application No. PCT/US03/03779, U.S. application Ser. No. 10/501,003, and U.S. application Ser. No. 11/314,851, each of which is incorporated by reference herein in its entirety.

An insulating microwave material used in accordance with the present invention may include at least one susceptor. By using an insulating microwave material in combination with a susceptor, more of the sensible heat generated by the susceptor is transferred to the surface of the food item rather than to the heating environment, thereby enhancing browning and crisping of the food item. In contrast, without the insulating material, some or all the heat generated by the susceptor may be lost via conduction to the surrounding air and other conductive media, such as the microwave oven floor or turntable. Furthermore, insulating microwave materials may retain moisture in the food item when cooking in the microwave oven, thereby improving the texture and flavor of the food item. Additionally, such packages often are cooler to the touch, thereby allowing a user to more comfortably grasp the food item.

Various exemplary insulating materials are depicted in FIGS. 6-11. In each of the examples shown herein, it should be understood that the layer widths are not necessarily shown in perspective. In some instances, for example, the adhesive layers may be very thin with respect to other layers, but are nonetheless shown with some thickness for purposes of clearly illustrating the arrangement of layers.

Figure 6:
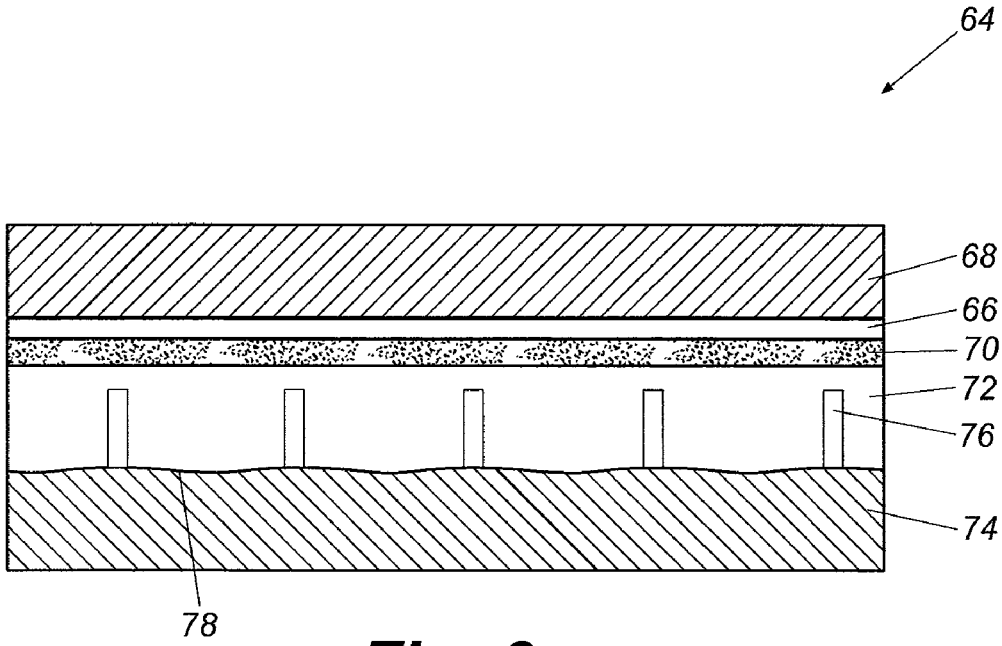
FIG. 6 depicts a cross-sectional view of an insulating microwave material that may be used in accordance with the present invention.

Turning to FIG. 6, the material 64 may be a combination of several different layers. A susceptor formed from a thin layer of microwave interactive material 66 on a first plastic film 68 is bonded, for example, using an adhesive 70, to a dimensionally stable substrate 72, for example, paper. The substrate 72 is bonded to a second plastic film 74 using a patterned adhesive 76 or other material, such that closed cells 78 are formed in the material 64. The closed cells 78 are substantially resistant to vapor migration. In this and other aspects of the present invention, where such materials are used, and where slits or perforations are formed, such perforations may be provided between the cells.

Thus, for example, an absorbent construct may include an expandable cell insulating material overlying an absorbent material, which optionally may overlie a liquid impervious layer. For example, the material 64 of FIG. 6 may be used to replace layers 12, 14, and 26 of the structure illustrated in FIG. 2, with the first plastic film 68, the microwave interactive material 66, and substrate 72 serving respectively as layers 12, 14, and 26 of the structure illustrated in FIG. 2. In such an example, perforations 20 would extend though the entire thickness of material 64. Other layers and combinations thereof are contemplated by the invention.

Figure 7:
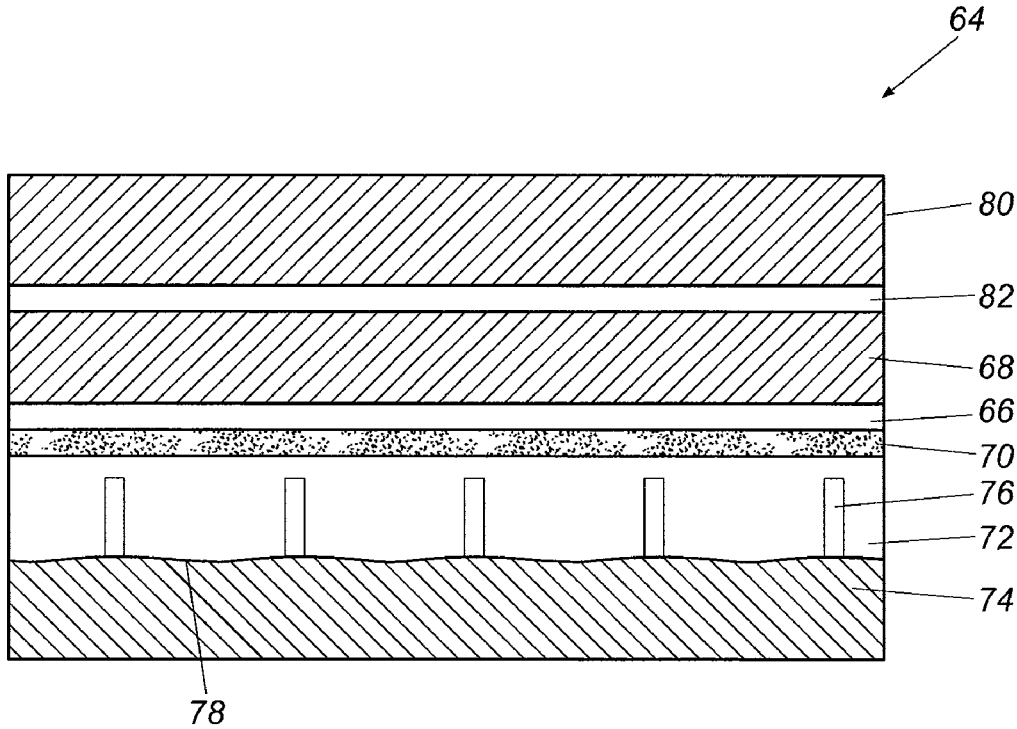
FIG. 7 depicts a cross-sectional view of another insulating microwave material that may be used in accordance with the present invention.

Optionally, an additional substrate layer 80 may be adhered by adhesive 82 or otherwise to the first plastic film 68 opposite the microwave interactive material 66, as depicted in FIG. 7. The additional substrate layer 80 may be a layer of paper or any other suitable material, and may be provided to shield the food item (not shown) from any flakes of susceptor film that craze and peel away from the substrate during heating. The insulating material 64 provides a substantially flat, multilayered sheet 84, as shown in FIG. 8.

Figure 8:
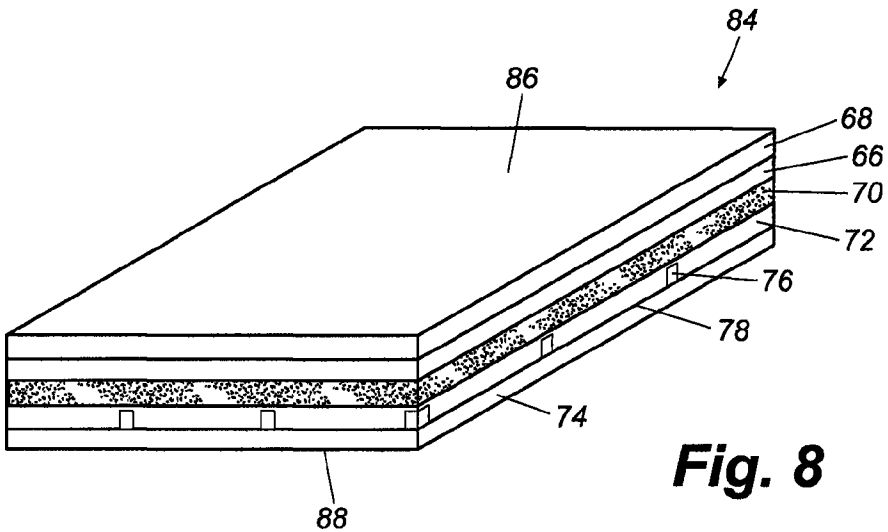
FIG. 8 depicts a perspective view of the insulating microwave material of FIG. 7.
Figure 9:
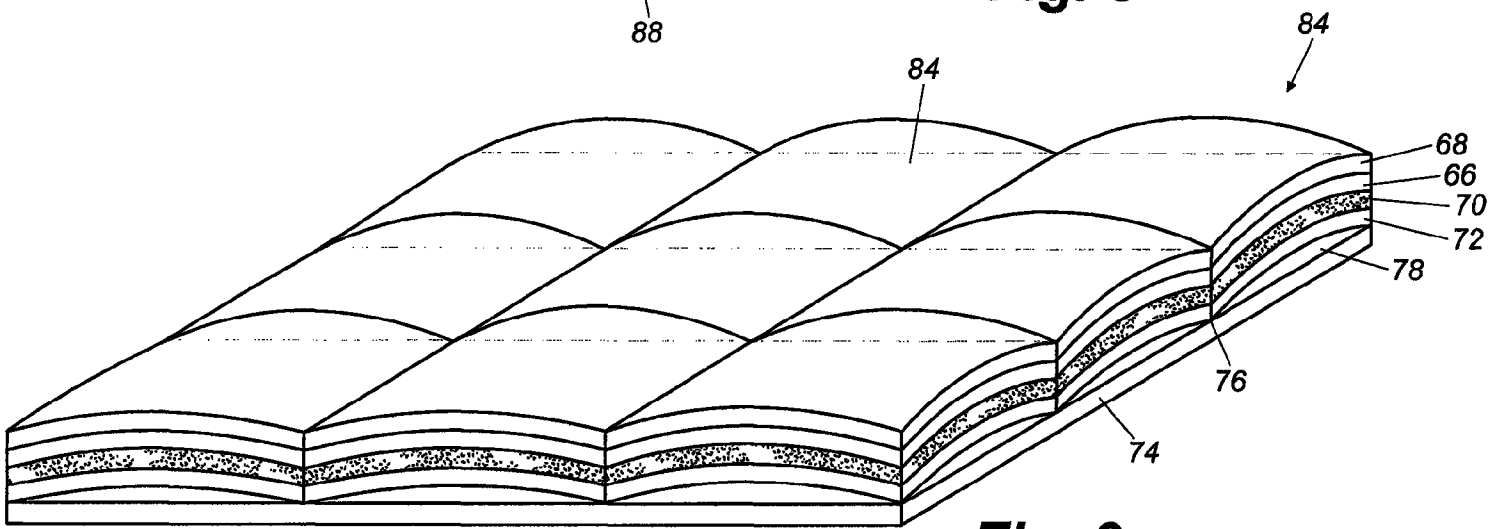
FIG. 9 depicts the insulating microwave material of FIG. 8 after exposure to microwave energy.

FIG. 9 depicts the exemplary insulating material 84 of FIG. 8 after being exposed to microwave energy from a microwave oven (not shown). As the susceptor heats upon impingement by microwave energy, water vapor and other gases normally held in the substrate 72, for example, paper, and any air trapped in the thin space between the second plastic film 74 and the substrate 72 in the closed cells 78, expand. The expansion of water vapor and air in the closed cells 78 applies pressure on the susceptor film 68 and the substrate 72 on one side and the second plastic film 74 on the other side of the closed cells 78. Each side of the material 64 forming the closed cells 78 reacts simultaneously, but uniquely, to the heating and vapor expansion. The cells 78 expand or inflate to form a quilted top surface 86 of pillows separated by channels (not shown) in the susceptor film 68 and substrate 72 lamination, which lofts above a bottom surface 88 formed by the second plastic film 74. This expansion may occur within 1 to 15 seconds in an energized microwave oven, and in some instances, may occur within 2 to 10 seconds.

Figure 10:
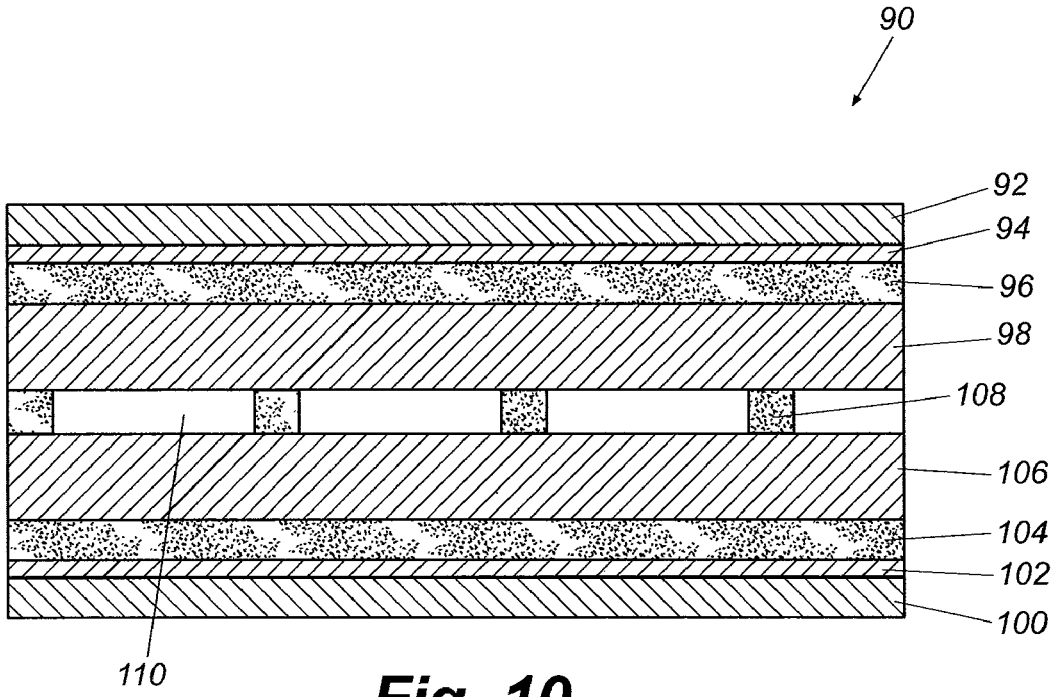
FIG. 10 depicts a cross-sectional view of yet another insulating microwave material that may be used in accordance with the present invention.
Figure 11:
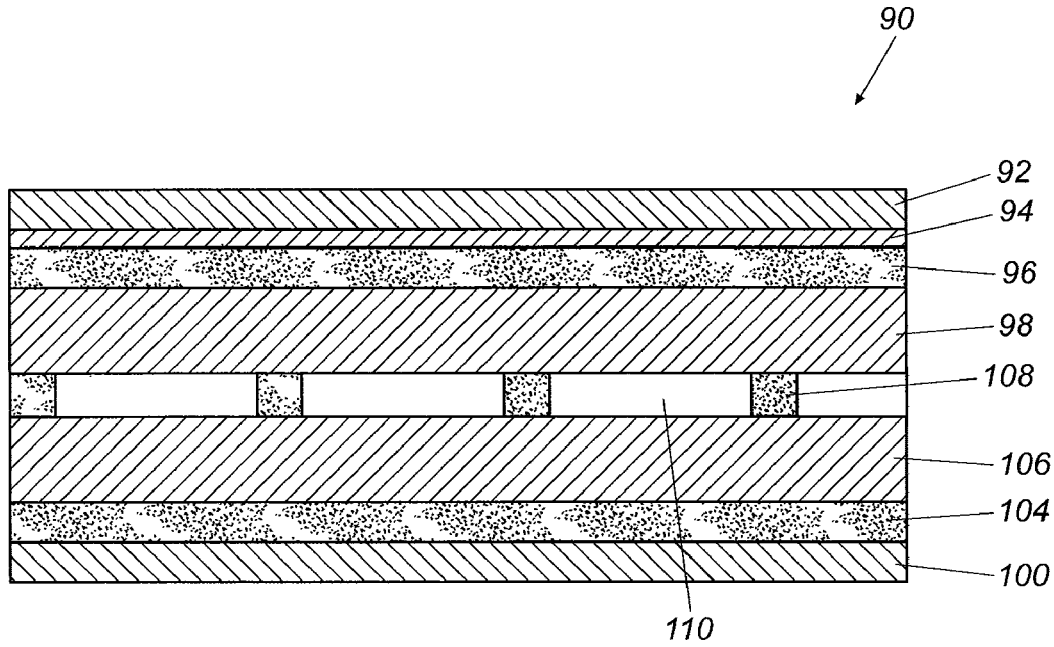
FIG. 11 depicts a cross-sectional view of still another insulating microwave material that may be used in accordance with the present invention.

FIGS. 10 and 11 depict alternative exemplary microwave insulating material layer configurations that may be suitable for use with any of the various packages of the present invention. Referring first to FIG. 10, an insulating microwave material 90 is shown with two symmetrical layer arrangements adhered together by a patterned adhesive layer. The first symmetrical layer arrangement, beginning at the top of the drawings, comprises a PET film layer 92, a metal layer 94, an adhesive layer 96, and a paper or paperboard layer 98. The metal layer 94 may comprise a metal, such as aluminum, deposited along a portion or all of the PET film layer 92. The PET film 92 and metal layer 94 together define a susceptor. The adhesive layer 96 bonds the PET film 92 and the metal layer 94 to the paperboard layer 98.

The second symmetrical layer arrangement, beginning at the bottom of the drawings, also comprises a PET film layer 100, a metal layer 102, an adhesive layer 104, and a paper or paperboard layer 106. If desired, the two symmetrical arrangements may be formed by folding one layer arrangement onto itself. The layers of the second symmetrical layer arrangement are bonded together in a similar manner as the layers of the first symmetrical arrangement. A patterned adhesive layer 108 is provided between the two paper layers 98 and 106, and defines a pattern of closed cells 110 configured to expand when exposed to microwave energy. In one aspect, an insulating material 90 having two metal layers 94 and 102 according to the present invention generates more heat and greater cell loft.

Referring to FIG. 11, yet another insulating microwave material 90 is shown. The material 90 may include a PET film layer 92, a metal layer 94, an adhesive layer 96, and a paper layer 98. Additionally, the material 90 may include a clear PET film layer 100, an adhesive 104, and a paper layer 106. The layers are adhered or affixed by a patterned adhesive 108 defining a plurality of closed expandable cells 110.

The absorbent constructs of the present invention may be used to form numerous products for various packaging and heating applications.

According to one aspect of the present invention, the absorbent construct is provided to the user for use with a variety of foods and cooking devices. The absorbent construct may be provided in various forms, and the user maintains a supply of the absorbent structure for use when needed.

For example, the absorbent structure may be used to form a pre-cut, disposable absorbent sheet for use in personal (home, work, travel, camping, etc.), commercial (e.g., restaurant, catering, vending, etc.), or institutional (e.g., university, hospital, etc.) applications. The sheet may be provided in any shape, for example, a square, rectangle, circle, oval, polygon, star, diamond, or any other pattern. The sheet may be provided in various sizes, for example, the sheet may be cut to fit standard plate sizes. The sheet may be individually wrapped for travel use, or may be provided as a wrapped stack of a plurality of sheets. The sheets may be provided in a box or a pouch. The sheets may be provided in a pop-up or pull-down dispenser, and may include individual folding or interfolding such as C-folding or tri-folding.

The absorbent sheet may be used to cook items in a microwave oven. The absorbent sheet may be dispensed from the package and optionally placed on a plate or tray. The food item is placed on the absorbent structure. As the food item cooks in the microwave oven, the exudates drain from the food item and pass through the various layers of the absorbent structure, if any, and is absorbed in the absorbent layer. As a result, the browning and/or crisping of the food item is enhanced. The absorbent structure then is discarded conveniently with the fat therein.

Figure 12:
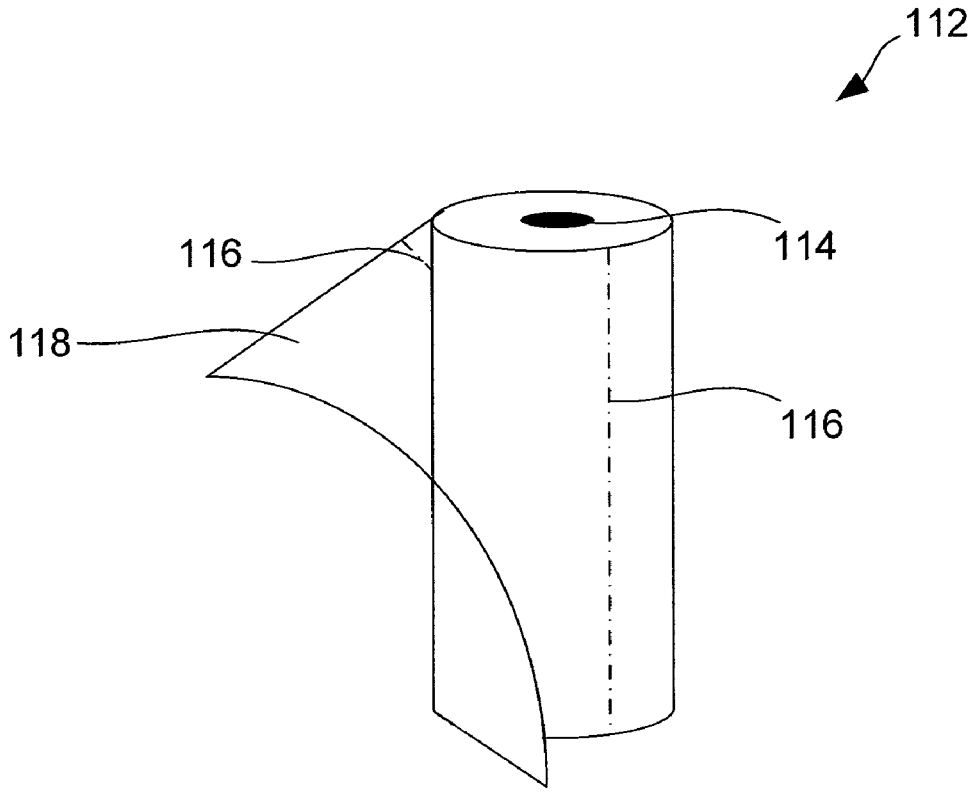
FIG. 12 depicts an exemplary roll of absorbent browning and/or crisping sheets according to various aspects of the invention.

Alternatively, the absorbent structure may be provided to the user as a roll 112 of absorbent material, as shown in FIG. 12. In one aspect, the roll is formed from a continuous web having a longitudinal dimension and a transverse dimension. The roll is formed by winding the material, optionally on a core 114, in the longitudinal direction. The roll may include transverse perforations 116 at spaced positions along the longitudinal dimension so that the user can tear a sheet 118 from the roll. The user can tear one or more sheets individually, or unwind the roll to remove two or more adjoined sheets. In another aspect, a roll is formed from a plurality of overlapping sheets, which may be contained in a flexible or rigid container with, for example, a lid with an opening for easy removal of the outermost sheet in the roll. The absorbent sheet is then dispensed through the opening in the lid.

Figure 13:
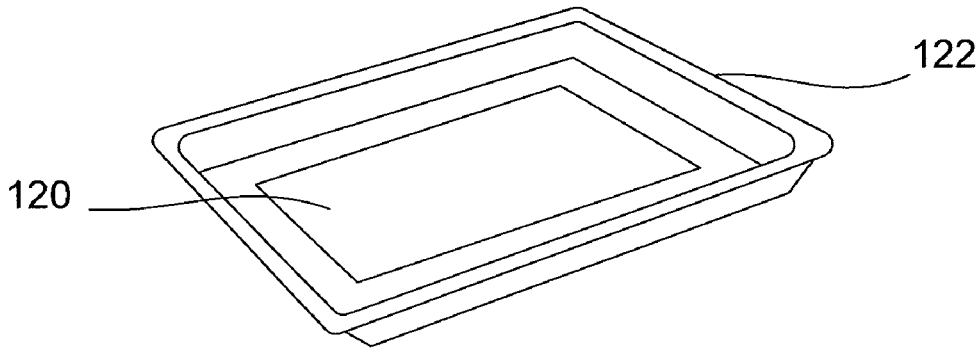
FIG. 13 depicts an exemplary absorbent browning and/or crisping sheet used with a conventional tray according to various aspects of the invention.

According to another aspect of the present invention, the absorbent structure may be provided as an absorbent sheet 120 for use in a tray or other container, for example, with the conventional tray 122 illustrated in FIG. 13. The particular form of the food container and/or packaging itself may comprise any one of numerous forms known to those skilled in the art such as, for example, wrapped trays, cardboard boxes, plastic containers, sealable bags, etc. In one aspect, the absorbent sheet is provided with a particular food item, but is maintained separate from the food item within the package until cooking. In another aspect, the food item is placed in intimate contact with the food item in the package. In this aspect, the absorbent sheet absorbs exudates before cooking and during and/or after cooking. The sheet may be attached to the tray or container, or may be held in position by the food item supported thereon.

When used with packaged meat and poultry, the absorbent structure may be placed over the central portion of a foam or plastic tray. Although rectangular configurations are most common, the actual dimensions of the tray can vary considerably depending on the nature and amount of product intended to be packaged. The absorbent structure may be sized to fit the tray as a single continuous unit or configured to overlay the tray in sections. Further, although the absorbent sheet can be simply placed over a support tray prior to placing the product thereon, the absorbent sheet may be permanently attached to the tray to prevent movement of the same in handling. As an example, the absorbent sheet may be adhesively attached to the tray. In addition, the absorbent sheet may be made an integral part of the tray itself.

The various constructs of the present invention may be formed according to a number of different processes. Such processes are well known to those of skill in the art and are described only briefly herein.

Each layer of the absorbent structure may be prepared and supplied as a wound roll of material. The layers may then be unwound, superposed, and bonded to form the absorbent structure. The layers may be adhesively bonded, mechanically bonded, thermally bonded, ultrasonically bonded, or any combination thereof, as described above. The degree and type of bonding is selected to provide sufficient structural integrity without impeding the flow of exudates to the absorbent layer.

Examples of thermal bonding processes include, but are not limited to, calendaring, through-air bonding, and point bonding. Point bonding involves passing the materials to be bonded between a heated calender roll and an anvil roll. The calender roll is usually, though not always, patterned so that the entire fabric is not bonded across its entire surface, and the anvil roll is usually flat. As a result, various patterns for calender rolls have been developed for functional as well as aesthetic reasons. Mechanical bonding includes use of staples, stitches, grommets, and other fasteners to join the layers. Adhesive bonding techniques employ, for example, adhesive tape, hot melt adhesives, and various curable adhesives. Ultrasonic bonding comprises passing the materials to be bonded between a sonic horn and anvil roll to convert mechanical energy to heat. In one aspect, a polymeric layer, such as polypropylene, polyethylene, or a combination or copolymer thereof, is applied between one or more other layers to join the layers.

The layers to be joined are selectively bonded to achieve a balance between structural integrity, strength, and permeability. In general, bonding increases strength and structural integrity, but decreases permeability. In one aspect, the peripheral edges are at least partially unbonded, so that exudates that have run off the food-contacting surface may be absorbed through the edges. The absorbent structure then may be wound into a roll, die cut, and packaged.

Alternatively, one or more of the various layers of the absorbent structure may be formed as part of a continuous process. Thus, for example, a release coating may be applied to a substrate, for example, a paper or nonwoven, and wound into a roll. Separately, a base sheet may be formed, and the absorbent layer may be formed thereon and bonded thereto using a polymeric binder. To assemble the absorbent structure, the two composites are brought together, superposed, bonded as described above, and made into the finished roll, sheet, pad, or other construct.

As discussed above, perforations may be provided in one or more layers of the construct, as needed or desired for a particular application. A partial depth cut often referred to as a "kiss cut" may be used to perforate fewer than all of the layers in an assembled construct. Perforations also may be formed using a dual cut web process of rotary die-cutting slits, such as that described in PCT application PCT/US03/00573 titled "Container and Methods Associated Therewith," which claims priority to related U.S. application Ser. No. 10/053,732 titled "Container and Methods Associated Therewith," filed on Jan. 18, 2002, and in U.S. patent application Ser. No. 10/318,437 titled "Packages, Blanks for Making Packages, and Associated Methods and Apparatus" filed on Dec. 13, 2002, all of which are hereby incorporated by reference herein. For example, the absorbent layer may be registered and adhered to the susceptor. Alternatively, such layers can be provided with slits prior to being assembled into the absorbent structure.

In one aspect, adhesive is applied between the perforation lines so the adhesive does not obstruct the flow of exudates through the perforations. By applying the adhesive in this manner, one or more of the various layers may be perforated prior to assembly of the construct. In another aspect, the construct may be assembled and any adhesive allowed to dry prior to perforating the various layers.

The present invention is further illustrated by the following examples, which are not to be construed in any way as imposing limitations upon the scope thereof. On the contrary, it is to be clearly understood that resort may be had to various other aspects, modifications, and equivalents thereof which, after reading the description herein, may be suggested to one of ordinary skill in the art without departing from the spirit of the present invention or the scope of the appended claims.

EXAMPLES

Various absorbent constructs were evaluated to determine whether a fluid impervious layer would prevent flow of exudate to the turntable of a microwave oven. A web cornered tray having a 6 inch by 6 inch base and 1 inch depth was prepared by laminating a metallized (aluminum) polyethylene terphthalate film to a paperboard support having a basis weight of about 130 lb/ream using about 4.4 gsm adhesive commercially available from Basic Adhesives (Brooklyn, N.Y.) under the trade name "3482". The resulting structure was laminated to "1279" absorbent filter paper obtained from Ahlstrom Corporation (Mount Holly Springs, Pa.) having a basis weight of about 123 gsm. Some samples then were laminated to a fluid impervious film prior to forming the tray. All samples were provided with about 198 cut scores or slits through the metallized film and the paperboard support and into (but not through) the absorbent paper using a CAD/CAM sample plotter table. The slits were about 0.25 inches long and spaced about 0.375 inches apart. The absorbent paper layer in each sample tray weighed about 2.5 g.

Each tray was positioned over a sheet of white copy machine paper and placed into an 1100 W microwave oven with about 5 grams of canola oil. The canola oil and tray were heated for about 2 minutes. The sample was removed from the microwave oven and observed for staining of the printer paper. The results are presented in Table 1. In each instance, most of the canola oil passed through the slits during heating. In each of the samples evaluated with a fluid impervious film, substantially all of the 5 grams of oil was absorbed by the 2.5 g absorbent layer.

TABLE 1

| Sample | Fluid Impervious Layer | Results |
|---|---|---|
| 1 | None | Staining observed |
| 2 | None | Staining observed |
| 3 | 48 gauge DuPont MELINEX ® PET | No staining observed |
| 4 | 48 gauge DuPont MELINEX ® PET | No staining observed |
| 5 | 48 gauge DuPont OB22 PET | No staining observed |
| 6 | 70 gauge Toray Plastics TORAYFAN F61W polypropylene | No staining observed |

It will be understood that in each of the various blanks and cartons described herein and contemplated hereby, a "fold line" can be any substantially linear, although not necessarily straight, form of weakening that facilitates folding therealong. More specifically, but not for the purpose of narrowing the scope of the present invention, a fold line may be a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features. Where cutting is used to create a fold line, the cutting typically will not be overly extensive in a manner that might cause a reasonable user to consider incorrectly the fold line to be a tear line.

For example, one type of conventional tear line is in the form of a series of cuts that extend completely through the material, with adjacent cuts being spaced apart slightly so that a nick (e.g., a small somewhat bridging-like piece of the material) is defined between the adjacent cuts for typically temporarily connecting the material across the tear line. The nicks are broken during tearing along the tear line. Such a tear line that includes nicks can also be referred to as a cut line, since the nicks typically are a relatively small percentage of the subject line, and alternatively the nicks can be omitted from such a cut line. As stated above, where cutting is used to provide a fold line, the cutting typically will not be overly extensive in a manner that might cause a reasonable user to consider incorrectly the fold line to be a tear line. Likewise, where nicks are present in a cut line (e.g., tear line), typically the nicks will not be overly large or overly numerous in a manner that might cause a reasonable user to consider incorrectly the subject line to be a fold line.

The terms "glue" and "glued" are intended to encompass any adhesive or manner or technique for adhering materials as are known to those of skill in the art. While use of the terms "glue" and "glued" are used herein, it will be understood that other methods of securing the various flaps are contemplated hereby.

Accordingly, it will be readily understood by those persons skilled in the art that, in view of the above detailed description of the invention, the present invention is susceptible of broad utility and application. Many adaptations of the present invention other than those herein described, as well as many variations, modifications, and equivalent arrangements will be apparent from or reasonably suggested by the present invention and the above detailed description thereof, without departing from the substance or scope of the present invention.

Although numerous embodiments of this invention have been described above with a certain degree of particularity, those skilled in the art could make numerous alterations to the disclosed embodiments without departing from the spirit or scope of this invention. All directional references (e.g., upper, lower, upward, downward, left, right, leftward, rightward, top, bottom, above, below, vertical, horizontal, clockwise, and counterclockwise) are only used for identification purposes to aid the reader's understanding of the embodiments of the present invention, and do not create limitations, particularly as to the position, orientation, or use of the invention unless specifically set forth in the claims. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

It will be recognized by those skilled in the art, that various elements discussed with reference to the various embodiments may be interchanged to create entirely new embodiments coming within the scope of the present invention. It is intended that all matter contained in the above description or shown in the accompanying drawings shall be interpreted as illustrative only and not limiting. Changes in detail or structure may be made without departing from the spirit of the invention as defined in the appended claims. The detailed description set forth herein is not intended nor is to be construed to limit the present invention or otherwise to exclude any such other embodiments, adaptations, variations, modifications, and equivalent arrangements of the present invention.

What is claimed is:

1. A microwave energy interactive absorbent insulating structure comprising:

an insulating microwave material including a plurality of expandable cells with unexpandable areas between the expandable cells; and an absorbent layer superposed with at least a portion of the insulating microwave material, wherein the insulating microwave material includes a layer of microwave energy interactive material supported on a first polymer film, a moisture-containing layer joined to the layer of microwave energy interactive material, and a second polymer film joined to the moisture-containing layer in a predetermined pattern, thereby defining the plurality of expandable cells between the moisture-containing layer and the second polymer film layer.

2. The absorbent insulating structure of claim 1, wherein at least some of the expandable cells inflate upon sufficient exposure to microwave energy.

3. The absorbent insulating structure of claim 1, wherein the absorbent layer is in a facing, substantially contacting relationship with the first polymer film of the insulating microwave material.

4. The absorbent insulating structure of claim 1, wherein the absorbent layer is in a facing, substantially contacting relationship with the second polymer film of the insulating microwave material.

5. The absorbent insulating structure of claim 1, further comprising a plurality of perforations extending through the unexpandable areas of the insulating microwave material.

6. The absorbent insulating structure of claim 1, further comprising a liquid impervious layer in a facing, substantially contacting relationship with the absorbent layer, such that the absorbent layer is disposed between the insulating microwave material and the liquid impervious layer.

7. An absorbent susceptor structure comprising:

a polymer film;

a layer of microwave energy interactive material supported on the polymer film;

an absorbent layer in a facing, substantially contacting relationship with the layer of microwave energy interactive material, the absorbent layer being capable of absorbing from about 0.5 to about 2.5 grams of exudate per gram of absorbent material; and a liquid impervious material in a facing, substantially contacting relationship with the absorbent layer, wherein the absorbent susceptor structure includes a plurality of perforations extending through the polymer film and the layer of microwave energy interactive material.

8. The absorbent susceptor structure of claim 7, wherein the polymer film comprises polypropylene, polyethylene, or any combination or copolymer thereof.

9. The absorbent susceptor structure of claim 7, wherein the layer of microwave energy interactive material comprises aluminum.

10. The absorbent susceptor structure of claim 7, wherein the layer of microwave energy interactive material comprises indium tin oxide.

11. The absorbent susceptor structure of claim 7, wherein the layer of microwave energy interactive material is sufficiently thin to convert at least a portion of impinging microwave energy into thermal energy.

12. The absorbent susceptor structure of claim 7, further comprising a dimensionally stable support disposed between the layer of microwave energy interactive material and the absorbent layer, wherein the perforations extend through the dimensionally stable support.

13. The absorbent susceptor structure of claim 12, wherein the dimensionally stable support is selected from the group consisting of paperboard, paper, and any combination thereof.

14. The absorbent susceptor structure of claim 7, wherein the structure is adapted to be transformed into a plurality of sheets.

15. The absorbent susceptor structure of claim 14, wherein the sheets are defined by at least one line of disruption extending substantially through the structure.

16. An absorbent structure comprising, in a layered configuration:

a polymer film;

a layer of microwave energy interactive material supported on the polymer film;

a liquid absorbing layer superposed with the layer of microwave energy interactive material, such that the layer of microwave energy interactive material is disposed between the polymer film and the liquid absorbing layer; and a liquid impervious material superposed with the liquid absorbing layer, such that the liquid absorbing layer is disposed between the layer of microwave energy interactive material and the liquid impervious layer, wherein the absorbent structure includes a plurality of perforations extending through the polymer film and the layer of microwave energy interactive material.

17. The absorbent structure of claim 16, wherein the polymer film comprises polyethylene terephthalate.

18. The absorbent structure of claim 16, wherein the layer of microwave energy interactive material comprises at least one of indium tin oxide and aluminum.

19. The absorbent structure of claim 16, wherein the liquid absorbing layer is capable of absorbing from about 0.5 to about 2.5 grams of exudate per gram of liquid absorbing layer.

20. The absorbent structure of claim 16, wherein the polymer film is a first polymer film, and the absorbent structure further comprises a moisture-containing layer joined to the layer of microwave energy interactive material, and a second polymer film joined to the moisture-containing layer in a patterned configuration, thereby defining a plurality of expandable cells between the moisture-containing layer and the second polymer film, and a plurality of unexpandable areas between the expandable cells, wherein the first polymer film, moisture-containing layer, and second polymer film at least partially define a microwave energy interactive insulating material.

21. The absorbent structure of claim 20, wherein the expandable cells are operative for inflating when the absorbent structure is sufficiently exposed to microwave energy.

22. The absorbent structure of claim 20, wherein at least some of the plurality of perforations extending through the polymer film and the layer of microwave energy interactive material extend through the unexpandable areas of the microwave energy interactive insulating material.

23. The absorbent structure of claim 16, formed into a roll of absorbent sheets.

24. The absorbent structure of claim 16, in combination with a tray.

25. The absorbent structure of claim 16, in combination with a blank for forming a microwave heating sleeve, the blank comprising a plurality of adjoined panels including a food-bearing panel adapted to receive a food item, wherein the absorbent structure overlies at least a portion of the food-bearing panel.

26. The combination of claim 25, wherein the plurality of adjoined panels further includes:

a first side panel and a second side panel joined to the food-bearing panel along respective fold lines;

a first portion of a food-opposing panel joined to the first side panel along a fold line; and a second portion of the food-opposing panel joined to the second side panel along a fold line.

27. The combination of claim 26, wherein when the plurality of panels is formed into the microwave heating sleeve, the food-bearing panel, the first side panel, the second side panel, and the food-opposing panel define a cavity for receiving the food item, the cavity being accessible through a pair of open ends of the sleeve.

28. The combination of claim 27, wherein at least one of the first side panel and the second side panel includes at least one aperture.

29. The combination of claim 27, wherein a susceptor overlies a side at least one of the first side panel, the second side panel, and the food-opposing panel facing the cavity.

30. An absorbent structure comprising, in a layered configuration:

a first polymer film;

a layer of microwave energy interactive material supported on the first polymer film;

a moisture-containing layer joined to the layer of microwave energy interactive material, such that the layer of microwave energy interactive material is disposed between the first polymer film and the moisture-containing layer;

a second polymer film joined to the moisture-containing layer in a patterned configuration, thereby defining a plurality of expandable cells between the moisture-containing layer and the second polymer film, and a plurality of unexpandable areas between the expandable cells, wherein the first polymer film, moisture-containing layer, and second polymer film at least partially define a microwave energy interactive insulating material;

a liquid absorbing layer superposed with the second polymer film, such that the second polymer film is disposed between the moisture-containing layer and the liquid absorbing layer; and a liquid impervious material superposed with the liquid absorbing layer, such that the liquid absorbing layer is disposed between the second polymer film and the liquid impervious layer, wherein the absorbent structure includes a plurality of perforations extending through the first polymer film, the layer of microwave energy interactive material, and the second polymer film.

31. The absorbent structure of claim 30, wherein the expandable cells inflate when the absorbent structure is exposed to microwave energy.

32. The absorbent structure of claim 30, wherein at least some of the plurality of perforations extending through the first polymer film, the layer of microwave energy interactive material, and the second polymer film extend through the unexpandable areas of the insulating material.

33. The absorbent structure of claim 30, wherein at least one of the first polymer film and the second polymer film comprises polyethylene terephthalate.

34. The absorbent structure of claim 30, wherein the layer of microwave energy interactive material comprises at least one of indium tin oxide and aluminum.

35. The absorbent structure of claim 30, wherein the liquid absorbing layer is capable of absorbing from 0.5 to 2.5 grams of liquid per gram of liquid absorbing layer.

36. The absorbent structure of claim 30, formed into a roll of absorbent sheets.

37. The absorbent structure of claim 30, in combination with a tray.

38. The absorbent structure of claim 30, in combination with a blank for forming a microwave heating sleeve, the blank comprising a plurality of adjoined panels including a food-bearing panel adapted to receive a food item, wherein the absorbent structure overlies at least a portion of the food-bearing panel.

39. The combination of claim 38, wherein the plurality of adjoined panels further includes:

a first side panel and a second side panel joined to the food-bearing panel along respective fold lines;

a first portion of a food-opposing panel joined to the first side panel along a fold line; and a second portion of the food-opposing panel joined to the second side panel along a fold line.

40. The combination of claim 39, wherein when the plurality of panels is formed into the microwave heating sleeve, the food-bearing panel, the first side panel, the second side panel, and the food-opposing panel define a cavity for receiving the food item, the cavity being accessible through a pair of open ends of the sleeve.

41. The combination of claim 39, wherein at least one of the first side panel and the second side panel includes at least one aperture.

42. The combination of claim 39, in wherein a microwave energy interactive material overlies a side at least one of the first side panel, the second side panel, and the food-opposing panel facing the cavity.

* * * * *